US008220103B1

(12) United States Patent
Lewis

(10) Patent No.: US 8,220,103 B1
(45) Date of Patent: Jul. 17, 2012

(54) MOP/PAD SYSTEM

(75) Inventor: Tanya M. Lewis, Palm Harbor, FL (US)

(73) Assignee: TL IP Licensing, LLC, Palm Harbor, FL (US)

( * ) Notice: Subject to any disclaimer, the term of this patent is extended or adjusted under 35 U.S.C. 154(b) by 1070 days.

(21) Appl. No.: 12/082,621

(22) Filed: Apr. 11, 2008

(51) Int. Cl.
*A47L 13/20* (2006.01)
*A47L 13/44* (2006.01)

(52) U.S. Cl. ..... 15/228; 15/118; 15/231

(58) Field of Classification Search ..... 15/118, 15/209.1, 210.1, 228, 229.1, 229.3, 231
See application file for complete search history.

(56) References Cited

U.S. PATENT DOCUMENTS

| | | | |
|---|---|---|---|
| 1,569,854 | A | 1/1926 | Doerr |
| 1,873,503 | A | 8/1932 | Stewart |
| 2,107,636 | A | 2/1938 | Kingman |
| 3,100,905 | A | 8/1963 | Salick |
| 3,908,218 | A | 9/1975 | Oishi |
| 4,184,224 | A | 1/1980 | Joffre |
| 4,769,267 | A | 9/1988 | Hoyt |
| 5,111,934 | A | 5/1992 | Morin |
| 5,134,746 | A | 8/1992 | William |
| 5,187,830 | A | 2/1993 | Giallourakis |
| 5,361,445 | A | 11/1994 | Giallourakis |
| 5,591,507 | A | 1/1997 | Jones |
| 5,671,498 | A | 9/1997 | Martin et al. |
| 5,887,311 | A | 3/1999 | Kresse et al. |
| 5,991,962 | A | 11/1999 | Nakatani |
| 6,013,349 | A | 1/2000 | Takeuchi et al. |
| 6,145,155 | A | 11/2000 | James et al. |
| 6,212,729 | B1 | 4/2001 | Weichelt et al. |
| 6,270,166 | B2 | 8/2001 | Weichelt et al. |
| 6,305,044 | B1 | 10/2001 | James et al. |
| D462,150 | S | 8/2002 | Rader et al. |
| 6,601,261 | B1 | 8/2003 | Holt et al. |
| 6,810,554 | B2 | 11/2004 | McKay |
| 6,849,135 | B2 | 2/2005 | Jones |
| 6,858,281 | B2 | 2/2005 | Kim |
| 6,993,805 | B2 | 2/2006 | Prodoehl et al. |
| 7,028,364 | B2 | 4/2006 | Policicchio et al. |
| 7,178,193 | B2 | 2/2007 | Jones |
| 7,225,496 | B2 | 6/2007 | Prodoehl et al. |
| 7,228,586 | B2 | 6/2007 | Prodoehl et al. |
| 7,264,413 | B2 | 9/2007 | Vosbikian et al. |
| 7,350,257 | B2 | 4/2008 | McKay |
| 7,413,614 | B2 | 8/2008 | Jones |
| 7,416,610 | B2 | 8/2008 | Jones |
| 7,442,259 | B2 | 10/2008 | Jones |
| 7,516,510 | B2 | 4/2009 | Tanaka |
| 7,653,961 | B2 | 2/2010 | Probasco |
| 2002/0032943 | A1 | 3/2002 | James et al. |
| 2004/0055102 | A1 | 3/2004 | Treacy et al. |
| 2004/0128786 | A1 | 7/2004 | Policicchio et al. |
| 2005/0155627 | A1 | 7/2005 | Bober et al. |
| 2005/0155630 | A1 | 7/2005 | Kilkenny et al. |
| 2005/0241095 | A1 | 11/2005 | Olson |

(Continued)

*Primary Examiner* — Randall Chin
(74) *Attorney, Agent, or Firm* — Kunzler Law Group, PC

(57) ABSTRACT

A pad for use with a rigid base plate is in a rectangular configuration. The pad has long front and back edges and short left and right side edges. The pad has upper and lower surfaces. The pad has an exterior lower sheet of pile-type microfiber material. The pad has an exterior upper sheet. In this manner a pocket is formed between the lower and upper sheets. The pad further has shammy material in the pocket. Mechanisms removably couple the upper surface of the pad to the lower surface of the base plate.

20 Claims, 3 Drawing Sheets

U.S. PATENT DOCUMENTS

2005/0250404 A1 11/2005 Clarke
2006/0213535 A1 9/2006 Porticos
2007/0061987 A1 3/2007 Kresse et al.
2007/0074364 A1 4/2007 Glaug
2007/0141299 A1 6/2007 Hong
2007/0256266 A1 11/2007 Michelson et al.
2008/0016640 A1 1/2008 Reddy et al.
2009/0007360 A1 1/2009 Jones
2009/0089951 A1 4/2009 Jones
2009/0178218 A1 7/2009 Jones
2009/0223540 A1 9/2009 Rosenzweig et al.
2009/0255079 A1* 10/2009 Neighley et al. ..... 15/209.1
2010/0012139 A1 1/2010 Perez

* cited by examiner 22
10
24
54
58
56

40
16
18
42
42
20
14
52
48
44
28
30
32
46
50

MOP/PAD SYSTEM

BACKGROUND OF THE INVENTION

1. Field of the Invention

The present invention relates to a mop/pad system and more particularly pertains to cleaning floors and like surfaces with a pad which is reusable, washable and replaceable, all in a sanitary, convenient and economical manner.

2. Description of the Prior Art

The use of cleaning systems of known designs and configurations is known in the prior art. More specifically, cleaning systems of known designs and configurations previously devised and utilized for the purpose of cleaning floors through known methods and apparatuses are known to consist basically of familiar, expected, and obvious structural configurations.

The prior art does not describe a mop/pad system that allows for cleaning floors and like surfaces with a pad which is reusable, washable and replaceable, all in a sanitary, convenient and economical manner.

In this respect, the mop/pad system according to the present invention provides an apparatus primarily developed for the purpose of cleaning floors and like surfaces with a pad which is reusable, washable and replaceable, all in a sanitary, convenient and economical manner.

Therefore, it can be appreciated that there exists a continuing need for a new and improved mop/pad system which can be used for cleaning floors and like surfaces with a pad which is reusable, washable and replaceable, all in a sanitary, convenient and economical manner. In this regard, the present invention substantially fulfills this need.

SUMMARY OF THE INVENTION

In view of the foregoing disadvantages inherent in the known types of cleaning systems of known designs and configurations now present in the prior art, the present invention provides an improved mop/pad system.

To attain this, the present invention essentially comprises a mop/pad system. First provided is a rigid base plate. The rigid base plate has a generally planar shape. The base plate is in a rectangular configuration. The base plate has a long front edge. The base plate has a parallel long back edge. The front and back edges are spaced by a width. The width is between 4 inches and 6 inches. The base plate has a short left side edge. The base plate has a parallel short right side edge. The left and right side edges are spaced by a length. The length is between 10 inches and 12 inches. The base plate has a midpoint. The midpoint is equally spaced from the long edges. The midpoint is equally spaced from the short edges. The base plate has a notch. The notch extends from the center of the back edge. The notch terminates in advance of the midpoint of the plate. The edges form four corners. The base plate has an upper surface. The base plate has a lower surface.

A handle is provided. The handle is in a linear configuration. The handle has an upper end. The handle has a lower end. The lower end of the handle has a swivel coupling. In this manner the handle is attached to the upper surface of the base plate midway between the front and back edges and midway between the side edges.

Provided next is a pad. The pad has a generally planar shape. The pad is in a rectangular configuration. The pad has a long front edge. The pad has a parallel long back edge. The front and back edges are spaced by a width. The width is between 4 inches and 6 inches. The pad has a short left side edge. The pad has a parallel short right side edge. The left and right side edges are spaced by a length. The length is between 10 inches and 12 inches. The edges form four corners. The pad has an upper surface. The pad has a lower surface. The pad has an exterior lower sheet. The exterior lower sheet is fabricated of a pile-type microfiber material. The pad has an exterior upper sheet. The exterior upper sheet is fabricated of a fabric selected from the class of fabrics including woven cotton and similar fabrics and blends thereof. In this manner a pocket is formed between the lower and upper sheets. The pad further has two layers of shammy material for absorbency.

Primary mechanisms are provided next. The primary mechanisms removably couple the upper surface of the pad to the lower surface of the base plate. The primary mechanisms include a long strip of a pile type fastener. The long strip is adhesively secured to the lower surface of the base plate along the front edge. The primary mechanisms include a short strip of pile type fasteners. The short strip is provided along the back edge on opposite sides of the notch. The primary mechanisms also include four patches of a pile-type fastener. The four patches are adhesively secured to the upper surface of the pad adjacent the corners of the pad. The pile type fasteners of the pad are adapted to be releasably coupled to the pile type fastener of the base plate during operation and use of the system.

Further provided are secondary mechanisms. The secondary mechanisms removably couple the pad to the base plate. The secondary mechanisms include four straps of a fabric selected from the class of fabrics including woven cotton and similar fabrics and blends thereof. The straps have upper and lower surfaces. The straps have a layer of shammy inside for stability. The four straps include two front straps. The two front straps extend in parallel from the front edge of the pad adjacent to the side edges. Each strap has a rectangular patch of a pile type fastener. The pile type fastener is stitched to the lower surface. The four straps include two back straps. The back straps extend in parallel from the back edge of the pad adjacent to the side edges. Each strap has a rectangular patch of a pile type fastener. The pile type fastener is stitched to the upper surface of the base plate along the front edge. The straps are adapted to be folded over the upper surface of the base plate. The pile type fasteners of the front straps releasably couple with the pile type fasteners of the back straps during operation and use of the system.

Provided last is a scrubbing assembly. The scrubbing assembly includes a triangular support. The triangular support is secured to the upper surface of the base plate adjacent to one side edge. The scrubbing assembly includes an abrasive cleaning component. The cleaning component is attached to the triangular support. The cleaning component has a lower edge. The lower edge is provided adjacent to the side edge. The cleaning component has an upper edge. The upper edge is spaced above and interiorly of the lower edge. In this manner an angle of about 30 degrees with respect to the base plate is formed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, reference should be had to the accompanying drawings and descriptive matter in which there is illustrated preferred embodiments of the invention.

BRIEF DESCRIPTION OF THE DRAWINGS

The invention will be better understood when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
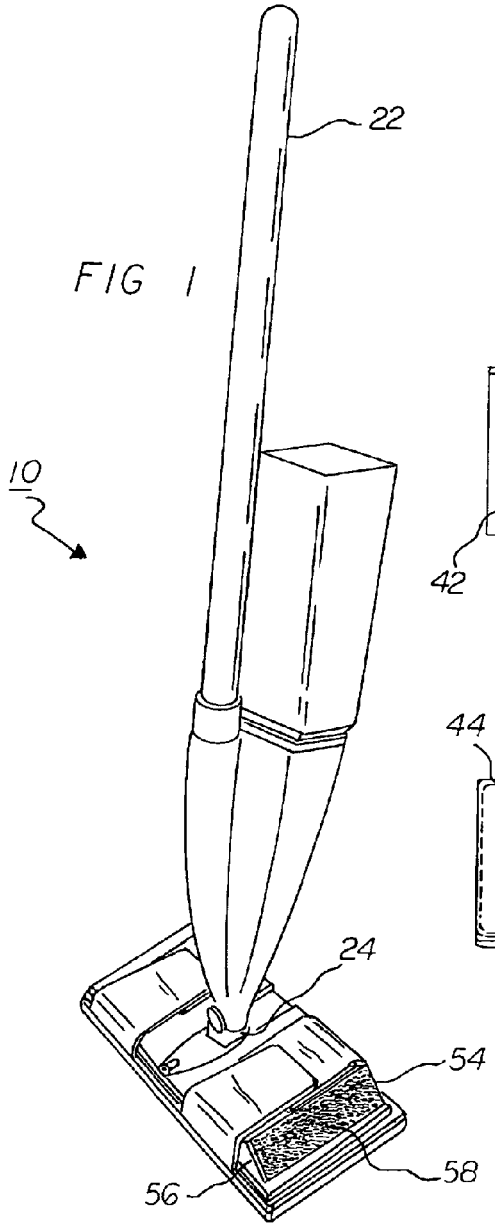
FIG. 1 is a perspective illustration of a mop/pad system constructed in accordance with the principles of the present invention.

With reference now to the drawings, and in particular to FIG. 1 thereof, the preferred embodiment of the new and improved mop/pad system embodying the principles and concepts of the present invention and generally designated by the reference numeral 10 will be described.

Referring to FIG. 1, the mop/pad system 10 is comprised of a plurality of components. Such components in their broadest context include a rigid base plate 14, a pad 28 and mechanisms. Such components are individually configured and correlated with respect to each other so as to attain the desired objective.

Figure 2:
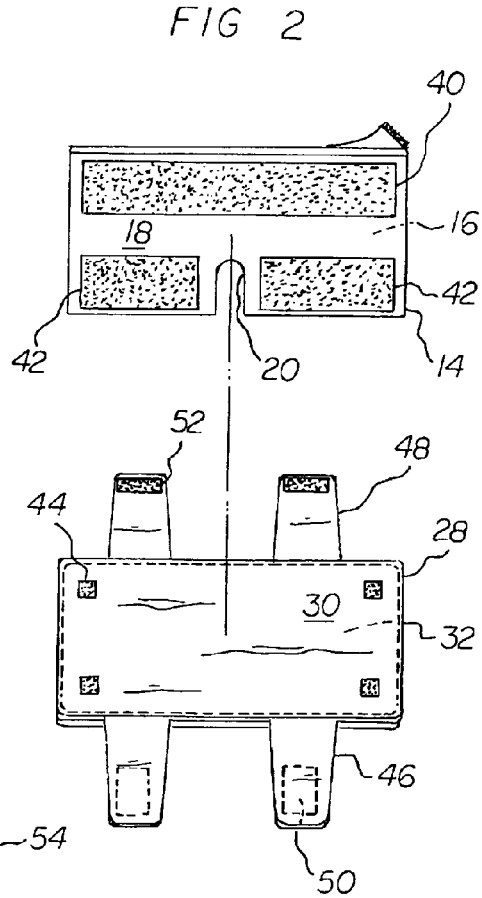
FIG. 2 is an exploded perspective illustration of the base plate to pad interface.

Referring to FIG. 2, first provided is a rigid base plate 14. The rigid base plate 14 has a generally planar shape. The base plate 14 is in a rectangular configuration. The base plate 14 has a long front edge. The base plate 14 has a parallel long back edge. The front and back edges are spaced by a width. The width is between 4 inches and 6 inches. The base plate 14 has a short left side edge. The base plate 14 has a parallel short right side edge. The left and right side edges are spaced by a length. The length is between 10 inches and 12 inches. The base plate 14 has a midpoint. The midpoint is equally spaced from the long edges. The midpoint is equally spaced from the short edges. The base plate 14 has a notch 20. The notch 20 extends from the center of the back edge. The notch 20 terminates in advance of the midpoint of the plate 14. The edges form four corners. The base plate 14 has an upper surface 16. The base plate 14 has a lower surface 18.

Referring now to FIG. 1, A handle 22 is provided. The handle 22 is in a linear configuration. The handle 22 has an upper end. The handle 22 has a lower end. The lower end of the handle 22 has a swivel coupling 24. In this manner the handle 22 is attached to the upper surface of the base plate 14 midway between the front and back edges and midway between the side edges. A supply of cleaning fluid is optionally secured to the system 10 to facilitate cleaning.

Figure 3:
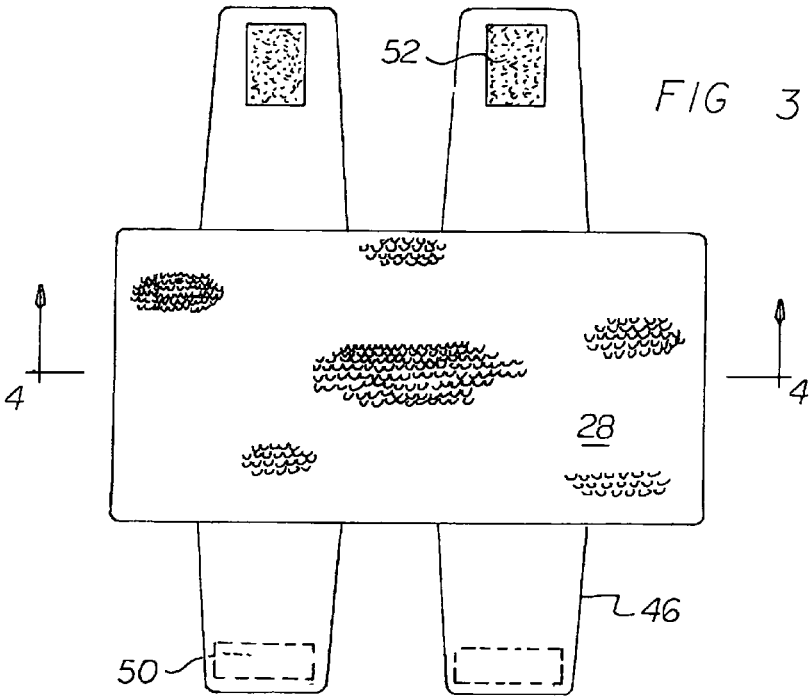
FIG. 3 is a plan view of the pad of the system shown in FIGS. 1 and 2.
Figure 4:
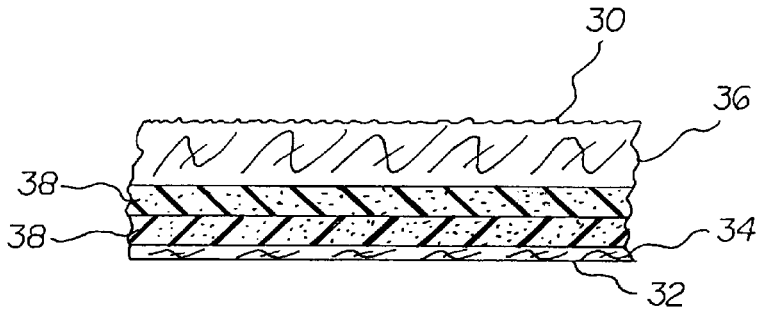
FIG. 4 is a cross sectional view taken along line 4-4 of FIG. 3.

Referring to FIG. 3, provided next is a pad 28. The pad 28 has a generally planar shape. The pad 28 is in a rectangular configuration. The pad 28 has a long front edge. The pad 28 has a parallel long back edge. The front and back edges are spaced by a width. The width is between 4 inches and 6 inches. The pad 28 has a short left side edge. The pad 28 has a parallel short right side edge. The left and right side edges are spaced by a length. The length is between 10 inches and 12 inches. The edges form four corners. Referring now to FIG. 3 and FIG. 4, the pad 28 has an upper surface 30. The pad 28 has a lower surface 32. The pad 28 has an exterior lower sheet 34. The exterior lower sheet 34 is fabricated of a pile-type microfiber material. The pad 28 has an exterior upper sheet 36. The exterior upper sheet 36 is of a fabric selected from the class of fabrics including woven cotton and similar fabrics and blends thereof. In this manner a pocket is formed between the lower 34 and upper 36 sheets. The pad 28 further has two layers of shammy material 38 for absorbency.

Referring to FIG. 2, primary mechanisms are provided next. The primary mechanisms removably couple the upper surface 30 of the pad 28 to the lower surface 18 of the base plate 14. The primary mechanisms include a long strip 40 of a pile type fastener. The long strip 40 is adhesively secured to the lower surface 18 of the base plate 14 along the front edge. The primary mechanisms include a short strip 42 of pile type fasteners. The short strip 42 is provided along the back edge on opposite sides of the notch 20. The primary mechanisms also include four patches 44 of a pile-type fastener. The four patches 44 are adhesively secured to the upper surface 30 of the pad 28 adjacent the corners of the pad 28. The pile type fasteners of the pad 28 are adapted to be releasably coupled to the pile type fastener of the base plate 14 during operation and use of the system 10.

Referring to FIG. 2 and FIG. 3, further provided are secondary mechanisms. The secondary mechanisms removably couple the pad 28 to the base plate 14. The secondary mechanisms include four straps 48, 46 of a fabric selected from the class of fabrics including woven cotton and similar fabrics and blends thereof. The straps 46, 48 have upper and lower surfaces. The straps 46, 48 have a layer of shammy inside for stability. The four straps 46, 48 include two front straps 48. The two front straps 48 extend in parallel from the front edge of the pad 28 adjacent to the side edges. Each strap 48 has a rectangular patch of a pile type fastener. The pile type fastener is stitched to the lower surface. The four straps 46, 48 include two back straps 46. The back straps 46 extend in parallel from the back edge of the pad 28 adjacent to the side edges. Each strap 46 has a rectangular patch 50 of a pile type fastener. The pile type fastener is stitched to the upper surface of the base plate 14 along the front edge. The straps 46 are adapted to be folded over the upper surface of the base plate 14. The pile type fasteners of the front straps 48 releasably couple with the pile type fasteners of the back straps 46 during operation and use of the system 10.

Referring to FIG. 1 and FIG. 2, provided last is a scrubbing assembly 54. The scrubbing assembly 54 includes a triangular support 56. The triangular support 56 is secured to the upper surface of the base plate 14 adjacent to one side edge. The scrubbing assembly 54 includes an abrasive cleaning component 58. The cleaning component 58 is attached to the triangular support 56. The cleaning component 58 has a lower edge. The lower edge is provided adjacent to the side edge. The cleaning component 58 has an upper edge. The upper edge is spaced above and interiorly of the lower edge. In this manner an angle of about 30 degrees with respect to the base plate 14 is formed.

Figure 5:
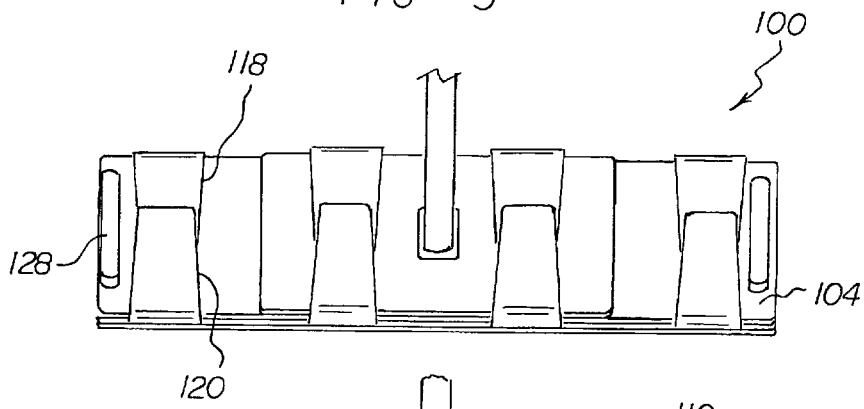
FIG. 5 is a perspective illustration of the lower portion of a mop/pad system constructed in accordance with an alternate embodiment of the invention.
Figure 6:
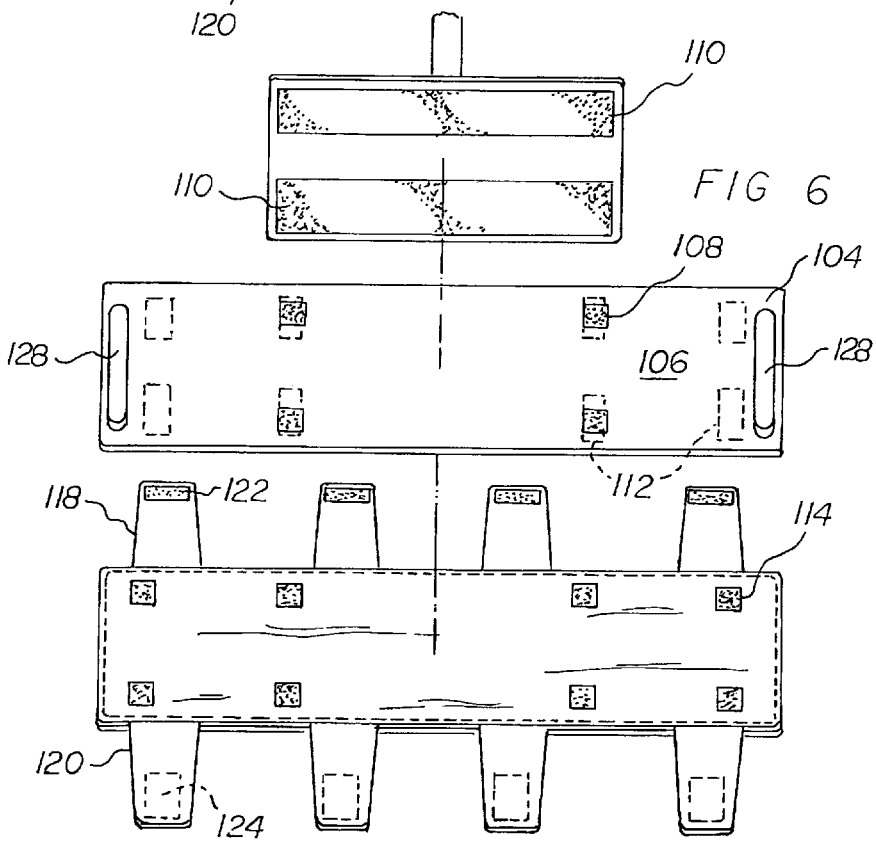
FIG. 6 is an exploded perspective illustration of the base plate to pad interface of the FIG. 5 embodiment.

Referring to FIG. 5, an alternate embodiment 100 of the present invention is provided. An extension plate 104 is provided. The extension plate 104 has a generally planar shape. The extension plate 104 is in a rectangular configuration. The extension plate 104 has a long front edge. The extension plate 104 has a parallel long back edge. The front and back edges are spaced by a width. The width is between 4 inches and 6 inches. The extension plate 104 has a short left side edge. The extension plate 104 has a parallel short right side edge. The left and right side edges are spaced by a length. The length is between 15 inches and 21 inches. The extension plate 104 has a length. The length of the extension plate 104 is between 4 and 10 inches greater than a base plate 14 to which it is to be coupled.

The extension plate 104 includes initial mechanisms. The initial mechanisms include an upper surface 106. The upper surface 106 has four patches 108 of a pile type fastener. Strips of a pile type fastener 110 is provided on the lower surface 18 of the base plate 14. The pile type fastener is adapted to releasably couple to the pile type fastener on a lower surface 18 of the base plate 14. The extension plate 104 has primary mechanisms. The primary mechanisms removably couple the upper surface of the pad 28 to the lower surface of the extension plate 104. The primary mechanisms include long strips 112 of a pile type fastener. The long strips are adhesively secured to the lower surface of the extension plate 104 along the front and back edges. The primary mechanisms also include patches 114 of a pile-type fastener. The patches are adhesively secured to the upper surface 30 of the pad 28. The pile type fasteners of the pad 28 are adapted to be releasably coupled to the pile type fastener of the base plate 14 during operation and use of the system 10.

The extension plate 104 includes secondary mechanisms. The secondary mechanisms removably couple the pad 28 to the extension plate 104. The secondary mechanisms include eight straps 118, 120 of material. The straps 118, 120 have upper and lower surfaces. The eight straps 118, 120 include four front straps 118. The straps 118 are provided in parallel from the front edge of the pad 28. Each strap 118 has a rectangular patch 122 of a pile type fastener. The pile type fastener is stitched to the lower surface. The eight straps 118, 120 include four back straps 120. The back straps 120 are provided in parallel from the back edge of the pad 28. Each strap 120 has a rectangular patch 124 of a pile type fastener. The pile type fastener is stitched to the upper surface. The straps 118, 120 are adapted to be folded over the upper surface of the base plate 14. The pile type fasteners of the front straps 118 releasably couple with the pile type fasteners of the back straps 120 during operation and use of the system 10.

The extension plate 104 includes weights 128. The weights 128 are provided adjacent to the side edges laterally offset from the base plate 14. In this manner a downward force is exerted. Further in this manner the contact between the pad 28 and a floor being cleaned is maximized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus comprising:

a pad with a front edge and a back edge and a left side edge and a right side edge, the pad having an upper surface and a lower surface, the pad being formed of an exterior lower sheet and an exterior upper sheet forming a pocket between the exterior lower sheet and the exterior upper sheet, the exterior lower sheet comprising microfiber material, the pad further having shammy material in the pocket; and mechanisms for removably coupling the upper surface of the pad to a lower surface of a base plate, the mechanisms comprising two front straps and two back straps, each strap having an upper surface and a lower surface, the two front straps extending in parallel from the front edge of the pad with each front strap having a patch of a fastener stitched to the lower surface, the two back straps extending in parallel from the back edge of the pad with each strap having a patch of a fastener stitched to the upper surface of the back strap, the front straps and the back straps adapted to be folded over an upper surface of the base plate with the fasteners of the front straps releasably coupling with the fasteners of the back straps.

2. The apparatus of claim 1, further comprising:

a base plate with a front edge and a back edge and a left side edge and a right side edge, the base plate having an upper surface and a lower surface.

3. The apparatus of claim 2, wherein the mechanisms include primary mechanisms comprising one or more strips of a fastener adhesively secured to the lower surface of the base plate.

4. The apparatus of claim 2 wherein the mechanisms comprise primary mechanisms including a plurality of patches of a fastener adhesively secured to the upper surface of the pad, the fasteners of the pad adapted to be releasably coupled to the one or more fasteners of the base plate.

5. The apparatus of claim 2, further including a handle coupled to the upper surface of the base plate.

6. The apparatus of claim 2, further including:

an extension plate releasably coupled to the base plate, the extension plate having a generally planar shape, the extension plate having a front edge and a back edge parallel to the front edge, the extension plate having a left side edge and a right side edge parallel to the left side edge.

7. The apparatus of claim 6 wherein the extension plate includes initial mechanisms having an upper surface with a plurality of patches of a fastener adapted to releasably couple to a fastener on a lower surface of the base plate.

8. The apparatus of claim 6 wherein the extension plate has primary mechanisms for removably coupling the upper surface of the pad to the lower surface of the extension plate, the primary mechanisms including one or more strips of a fastener adhesively secured to the lower surface of the extension plate, the primary mechanisms also including a plurality of patches of a fastener adhesively secured to the upper surface of the pad, the fasteners of the pad adapted to be releasably coupled to the one or more strips of the fastener of the base plate.

9. The apparatus of claim 8 wherein the pad includes secondary mechanisms for removably coupling the pad to the extension plate, the secondary mechanisms comprising four front straps and four back straps, each strap having an upper surface and a lower surface, the four front straps extending in parallel from the front edge of the pad with each front strap having a patch of a fastener stitched to the lower surface, the four back straps extending in parallel from the back edge of the pad with each strap having a patch of a fastener stitched to the upper surface, the front straps and the back straps adapted to be folded over the upper surface of the base plate with the fasteners of the front straps releasably coupling with the fasteners of the back straps.

10. The apparatus of claim 6, further including weights in the extension plate adjacent to the side edges laterally offset from the base plate for exerting a downward force to maximize contact between the pad and a floor being cleaned.

11. An apparatus comprising:

a pad with a front edge and a back edge and a left side edge and a right side edge, the pad having an upper surface and a lower surface, the pad being formed of an exterior lower sheet and an exterior upper sheet forming a pocket between the exterior lower sheet and the exterior upper sheet, the exterior lower sheet comprising pile-type microfiber material, the pad further having at least one layer of shammy material in the pocket;

a base plate with a front edge and a back edge and a left side edge and a right side edge, the base plate having an upper surface and a lower surface; and mechanisms for removably coupling the upper surface of the pad to the lower surface of the base plate, wherein the mechanisms include primary mechanisms comprising one or more strips of a fastener adhesively secured to the lower surface of the base plate.

12. The apparatus of claim 11, wherein the primary mechanisms comprise one or more strips of a pile-type fastener, each strip of the pile-type fastener adhesively secured along one of the front edge and the back edge of the lower surface of the base plate, the primary mechanisms also including a plurality of patches of a pile-type fastener adhesively secured to the upper surface of the pad, the pile-type fasteners of the pad adapted to be releasably coupled to the one or more pile-type fasteners of the base plate.

13. The apparatus of claim 11 wherein the mechanisms include secondary mechanisms comprising two front straps and two back straps, each strap having an upper surface and a lower surface, the two front straps extending in parallel from the front edge of the pad with each front strap having a patch of a pile-type fastener stitched to the lower surface, the two back straps extending in parallel from the back edge of the pad with each strap having a patch of a pile-type fastener stitched to the upper surface of the back strap, the front straps and the back straps adapted to be folded over the upper surface of the base plate with the pile-type fasteners of the front straps releasably coupling with the pile-type fasteners of the back straps.

14. The apparatus of claim 11, further including a handle coupled to the upper surface of the base plate.

15. The apparatus of claim 11, further including:

an extension plate having a generally planar shape, the extension plate having a front edge and a parallel back edge, the extension plate having a left side edge and a parallel right side edge, wherein the extension plate includes initial mechanisms having an upper surface with a plurality of patches of a pile-type fastener adapted to releasably couple to a pile-type fastener on a lower surface of the base plate.

16. The apparatus of claim 15 wherein the extension plate has primary mechanisms for removably coupling the upper surface of the pad to the lower surface of the extension plate, the primary mechanisms including one or more strips of a pile-type fastener adhesively secured to the lower surface of the extension plate, the primary mechanisms also including a plurality of patches of a pile-type fastener adhesively secured to the upper surface of the pad, the pile-type fasteners of the pad adapted to be releasably coupled to the one or more strips of the pile-type fastener of the base plate.

17. The apparatus of claim 16 wherein the extension plate includes secondary mechanisms for removably coupling the pad to the extension plate, the secondary mechanisms comprising four front straps and four back straps, each strap having an upper surface and a lower surface, the four front straps extending in parallel from the front edge of the pad with each front strap having a patch of a pile-type fastener stitched to the lower surface, the four back straps extending in parallel from the back edge of the pad with each strap having a patch of a pile-type fastener stitched to the upper surface, the front straps and the back straps adapted to be folded over the upper surface of the base plate with the pile-type fasteners of the front straps releasably coupling with the pile-type fasteners of the back straps.

18. The apparatus of claim 15, further including weights in the extension plate adjacent to the side edges laterally offset from the base plate for exerting a downward force to maximize contact between the pad and a floor being cleaned.

19. A mop system comprising:

a pad having a generally planar shape, the pad having a front edge and a back edge, the front edge parallel to the back edge, the front edge and the back edge spaced by a width of between 4 inches and 6 inches, the pad having a left side edge and a right side edge, the left side edge parallel to the right side edge, the left side edge and the right side edge spaced by a length of between 10 inches and 12 inches, the pad having an upper surface and a lower surface, the pad being formed of an exterior lower sheet and an exterior upper sheet forming a pocket between the exterior lower sheet and the exterior upper sheet, the exterior lower sheet comprising pile-type microfiber material, the pad further having a plurality of layers of shammy material in the pocket;

a base plate having a generally planar shape with a front edge and a back edge, the front edge parallel to the back edge, the front edge and the back edge spaced by a width of between 4 inches and 6 inches, the base plate having a left side edge and a right side edge, the left side edge parallel to the right side edge, the left side edge and the right side edge spaced by a length of between 10 inches and 12 inches, the base plate having an upper surface and a lower surface;

primary mechanisms for removably coupling the upper surface of the pad to the lower surface of the base plate comprising one or more strips of a pile-type fastener adhesively secured to the lower surface of the base plate, wherein the primary mechanisms also include a plurality of patches of a pile-type fastener adhesively secured to the upper surface of the pad, the pile-type fasteners of the pad adapted to be releasably coupled to the one or more pile-type fasteners of the base plate;

secondary mechanisms comprising two front straps and two back straps, each strap having an upper surface and a lower surface, the two front straps extending in parallel from the front edge of the pad with each front strap having a patch of a pile-type fastener stitched to the lower surface, the two back straps extending in parallel from the back edge of the pad with each strap having a patch of a pile-type fastener stitched to the upper surface of the back strap, the front straps and the back straps adapted to be folded over the upper surface of the base plate with the pile-type fasteners of the front straps releasably coupling with the pile-type fasteners of the back straps; and a handle in a linear configuration with an upper end and a lower end, the lower end of the handle including a swivel coupling for attaching the handle to the upper surface of the base plate.

20. An apparatus comprising:

a pad with a front edge and a back edge and a left side edge and a right side edge, the pad having an upper surface and a lower surface, the pad being formed of an exterior lower sheet and an exterior upper sheet forming a pocket between the exterior lower sheet and the exterior upper sheet, the exterior lower sheet comprising microfiber material, the pad further having shammy material in the pocket;

a base plate with a front edge and a back edge and a left side edge and a right side edge, the base plate having an upper surface and a lower surface; and mechanisms for removably coupling the upper surface of the pad to the lower surface of the base plate, the mechanisms comprising primary mechanisms including a plurality of patches of a fastener adhesively secured to the upper surface of the pad, the fasteners of the pad adapted to be releasably coupled to one or more fasteners of the base plate.

* * * * *